US005568162A

United States Patent [19]

Samsel et al.

[11] Patent Number: 5,568,162

[45] Date of Patent: Oct. 22, 1996

[54] GPS NAVIGATION AND DIFFERENTIAL-CORRECTION BEACON ANTENNA COMBINATION

[75] Inventors: Robert A. Samsel, Saratoga; Brian G. Westfall, Mountain View; Stephen K. Will, Sunnyvale, all of Calif.

[73] Assignee: Trimble Navigation Limited, Sunnyvale, Calif.

[21] Appl. No.: 287,188

[22] Filed: Aug. 8, 1994

[51] Int. Cl.[6] ..... H01Q 7/04; H01Q 1/52

[52] U.S. Cl. ..... 343/842; 343/788; 343/726; 343/728

[58] Field of Search ..... 343/842, 841, 343/787, 788, 725, 726, 727, 728, 729, 730; H01Q 7/04, 1/52

[56] References Cited

U.S. PATENT DOCUMENTS

| | | | |
|---|---|---|---|
| 1,608,974 | 11/1926 | Blatterman | 343/842 |
| 4,407,000 | 9/1983 | Sasaki et al. | 343/726 |
| 4,827,275 | 5/1989 | Fusinski | 343/726 |
| 4,890,115 | 12/1989 | Hartings | 343/841 |

FOREIGN PATENT DOCUMENTS

| | | | |
|---|---|---|---|
| 60-210011 | 10/1985 | Japan | 343/728 |

*Primary Examiner*—Hoanganh Le

*Attorney, Agent, or Firm*—Law Offices of Thomas E. Schatzel

[57] ABSTRACT

An antenna system comprises a stack of elements that include a GPS patch antenna on a groundplane with an associated low-noise amplifier (LNA), a first Faraday shield of flat ribbon cable covering a first ferrite rod magnetic field antenna, a second ferrite rod magnetic field antenna separated from and orthogonal to the first ferrite rod magnetic field antenna, a second Faraday shield of flat ribbon cable covering the second ferrite rod magnetic field antenna and having a LNA for each of the ferrite rod magnetic field antennas. A third Faraday shield is positioned between the first and second ferrite rod magnetic field antennas. All the Faraday shields are connected to ground such that there are no loops that may act as shorted turns to avoid desensitizing the ferrite rod magnetic field antennas.

6 Claims, 2 Drawing Sheets

GPS NAVIGATION AND DIFFERENTIAL-CORRECTION BEACON ANTENNA COMBINATION

BACKGROUND OF THE INVENTION

1. Field of the Invention

The invention relates generally to radio antennas and more specifically to combinations of antennas suited for use with global positioning system receivers equipped with differential-correction beacon receivers.

2. Description of the Prior Art

Global positioning system (GPS) receivers can either be one of two types, authorized or unauthorized. The authorized GPS receivers are able to receive and decode a second carrier channel (L2) from the orbiting GPS satellites that carries precision code (P-code) data that must be decrypted with a special military decryption device. When selective availability (SA) is engaged by the government, the position accuracy of unauthorized GPS receivers is degraded because such receivers are able to only use the coarse acquisition (C/A) code available on the primary carrier channel (L1), and that data is deliberately dithered during SA. Position solutions that are computed therefore become randomly skewed over time in heading and distance from the perfect solution.

Since all stations in an area will be more-or-less equally affected by SA, stations with known fixed locations can assess the dither offsets by comparing GPS computed positions with the known position. Such differential correction signals can then be broadcast in real-time on a low frequency beacon channel to be used by GPS receivers in the area to correct their computed positions by an appropriate direction and magnitude. Differential GPS can provide two to five meter accuracy for even unauthorized GPS receivers. Such a beacon station is in operation at Montauk, N.Y.

Commercial GPS receivers have evolved to the point that special input/output (I/O) ports are provided on them to accept differential correction data from a separate beacon receiver. For example, Trimble Navigation (Sunnyvale, Calif.) provides a 4000 RL REFERENCE LOCATOR™ device that can calculate and transmit differential corrections to mobile GPS receivers. It can be configured with either eight or twelve channels to track all the GPS satellites in view. A common differential correction data format used in the industry is called "RTCM-SC104". Many commercial products are equipped to generate and receive RTCM-SC104 data.

Combined GPS and differential beacon receivers are desirable because separate components can be awkward and unwieldy in mobile use, e.g., in small boats or infantry units in the field. A combination of antennas is therefore required, but the respective GPS antennas and beacon antennas have special requirements for shielding and access to an unobstructed sky.

GPS antennas operate at such high frequencies and at such low signal levels that a typical patch or folded dipole antenna cannot be shadowed or covered by the receiver's enclosure or other circuitry. GPS antennas are therefore typically mounted upright and atop the unit with nothing more than a small plastic radome to keep out the weather and to provide mechanical protection.

Beacon receiver magnetic loop antennas, for example those operating at 300 kilohertz (KHz), need Faraday shielding to block out the electrostatic field and keep the received background noise to a minimum. The prior art includes the use of ferrite rod magnetic field antennas with Faraday shields constructed of ribbon cable circumferencially wound in an orbit around each ferrite rod and cut and soldered at one end to form a grounded comb cylinder. Such construction is labor intensive and can lower the antenna-Q of the magnetic field antenna.

SUMMARY OF THE PRESENT INVENTION

It is therefore an object of the present invention to provide an antenna combination for GPS and differential-correction beacon reception.

It is a further object of the present invention to provide an antenna combination that is economical to manufacture.

It is another object of the present invention to provide an antenna combination that is practical in mobile and portable applications.

Briefly, an exemplary antenna system embodiment of the present invention comprises a stack of elements in a single enclosure that include a GPS patch antenna on a groundplane with an associated low-noise amplifier (LNA), a first Faraday shield of flat ribbon cable covering a first ferrite rod magnetic field antenna, a second ferrite rod magnetic field antenna separated from and orthogonal to the first ferrite rod magnetic field antenna, a second Faraday shield of flat ribbon cable covering the second ferrite rod magnetic field antenna and having a LNA for each of the ferrite rod magnetic field antennas. Both Faraday shields are connected to ground such that there are no loops that may act as shorted turns to avoid desensitizing the ferrite rod magnetic field antennas.

An advantage of the present invention is that an antenna combination is provided that can receive both GPS signals from orbiting satellites and beacon signals from differential correction ground stations.

Another advantage of the present invention is that an antenna combination is provided that has substantially reduced manufacturing costs associated with its production.

A further advantage Of the present invention is that an antenna combination is provided that is useful in portable and mobile applications.

These and other objects and advantages of the present invention will no doubt become obvious to those of ordinary skill in the art after having read the following detailed description of the preferred embodiment which is illustrated in the drawing figures.

IN THE DRAWINGS

DETAILED DESCRIPTION OF THE PREFERRED EMBODIMENT

Figure 1:
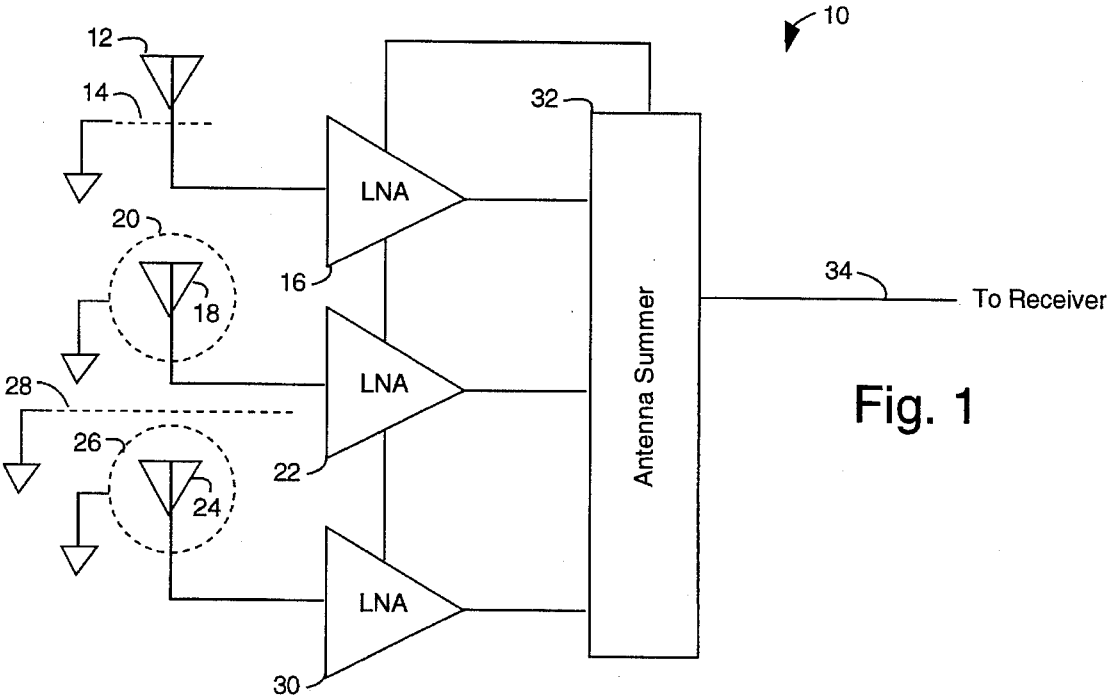
FIG. 1 is a schematic diagram of an antenna combination embodiment of the present invention.

FIG. 1 illustrates an antenna combination embodiment of the present invention, referred to herein by the general reference numeral 10. Antenna combination 10 provides in a single enclosure or package both types of antennas needed to support differential beacon reception and global positioning system (GPS) satellite range signal reception for a differentially corrected GPS navigation receiver. The antenna combination 10 comprises a GPS antenna 12 on a groundplane 14 with an associated low-noise amplifier (LNA) 16; a first beacon magnetic loop antenna 18 surroundedby a Faraday shield 20 and associated with a low-noise amplifier (LNA) 22; a second beacon magnetic loop antenna 24 surrounded by a Faraday shield 26; a middle Faraday shield 28; a low-noise amplifier (LNA) 30; an antenna summer 32 and a composite output 34. The magnetic loop antennas 18 and 24 comprise ferrite rods and are set apart and at right angles to one another to provide for omni-directional reception of ground-based beacon broadcasting stations. The patch antenna 12 is preferably oriented and configured to have a hemispherical reception pattern to enable reception of orbiting GPS satellite radio transmissions.

Signals received by the antenna 12 are typically in the microwave range, as radio transmitted by orbiting GPS satellites, and are spread spectrum encoded on two separate carrier frequencies, "L1" and "L2". Signals received by antennas 18 and 24 have carrier frequencies of approximately 300 KHz (longwave) and are modulated, e.g., with RTCM-SC104 format differential correction data.

Faraday shields 20, 26 and 28 each respectively shield antennas 18 and 24 from radio electrostatic fields (E-fields) by shunting such E-15 fields to ground. The signal performance is thus improved by permitting only radio electromagnetic fields to penetrate through to the antennas 18 and 24. It is important that Faraday shields 20, 26 and 28 not have any electrical closed loops that will create shorted turns, or solid metal surfaces that can set up eddy currents, either can desensitize ("de-Q") the antennas 18 and 24 and worsen beacon signal reception.

Figure 2:
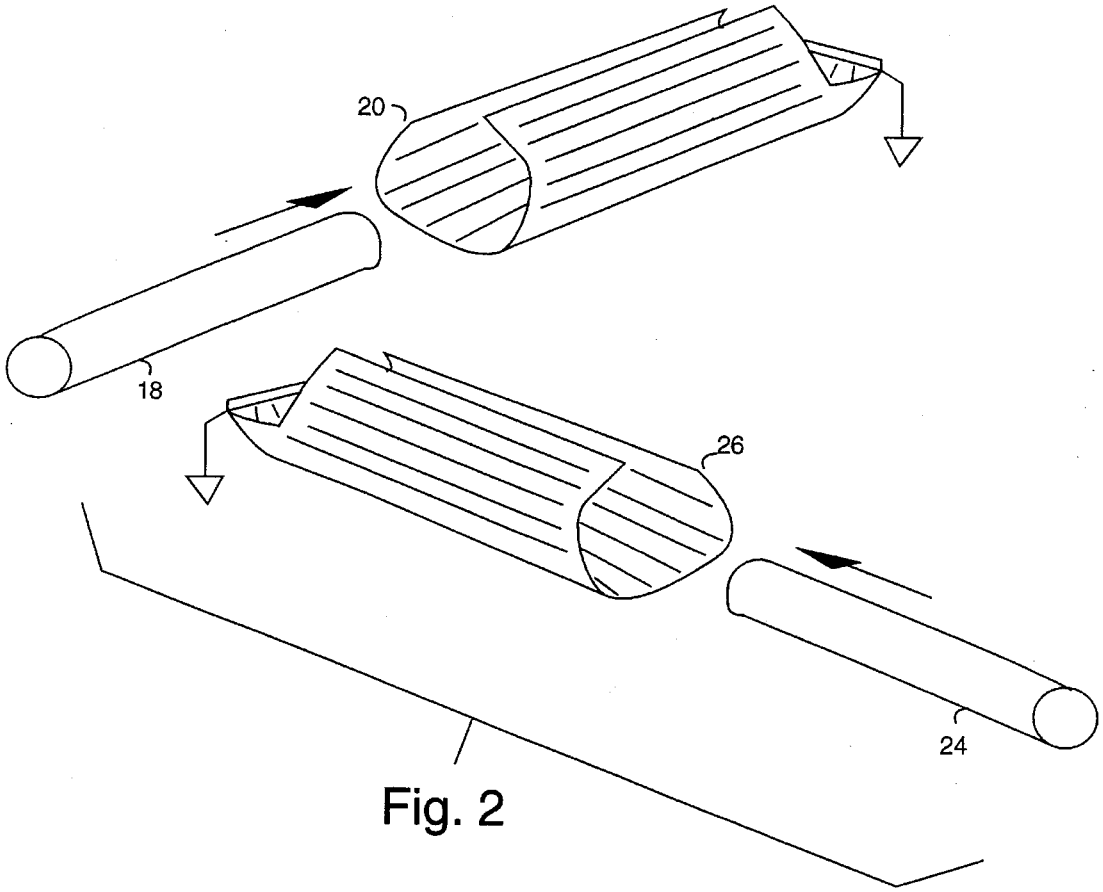
FIG. 2 is a perspective view of a flat ribbon conductor wrapping of the magnetic dipole antennas of FIG. 1 to implement Faraday shielding.

Multi-conductor flat ribbon cable is preferably used to implement Faraday shields 20, 26 and 28. Each antenna 18 and 24 is individually wrapped with ribbon cable. For example, as shown in FIG. 2, a flat ribbon cable that has a width sufficient to wrap around a spaced distance from the outer circumference of antenna 18 or 24 is used. The individual conductors within the ribbon cable are oriented to run parallel to the ferrite rod of the antenna. These individual conductors are gathered together at one end and connected to ground, e.g., with a mass-terminated ribbon connector for low-cost manufacturing. The ground connection may alternatively be made anywhere at a single point along the ribbon cable, but a connection to ground at one end is usually the simplest way to electrically connect to the ribbon cable. The one or two free ends of the ribbon cable are preferably long enough to be wrapped around the ends of the respective ferrite rod. The free end of the ribbon cable is left electrically open, thus tape or another insulator is used to prevent accidental shorting.

Figure 3:
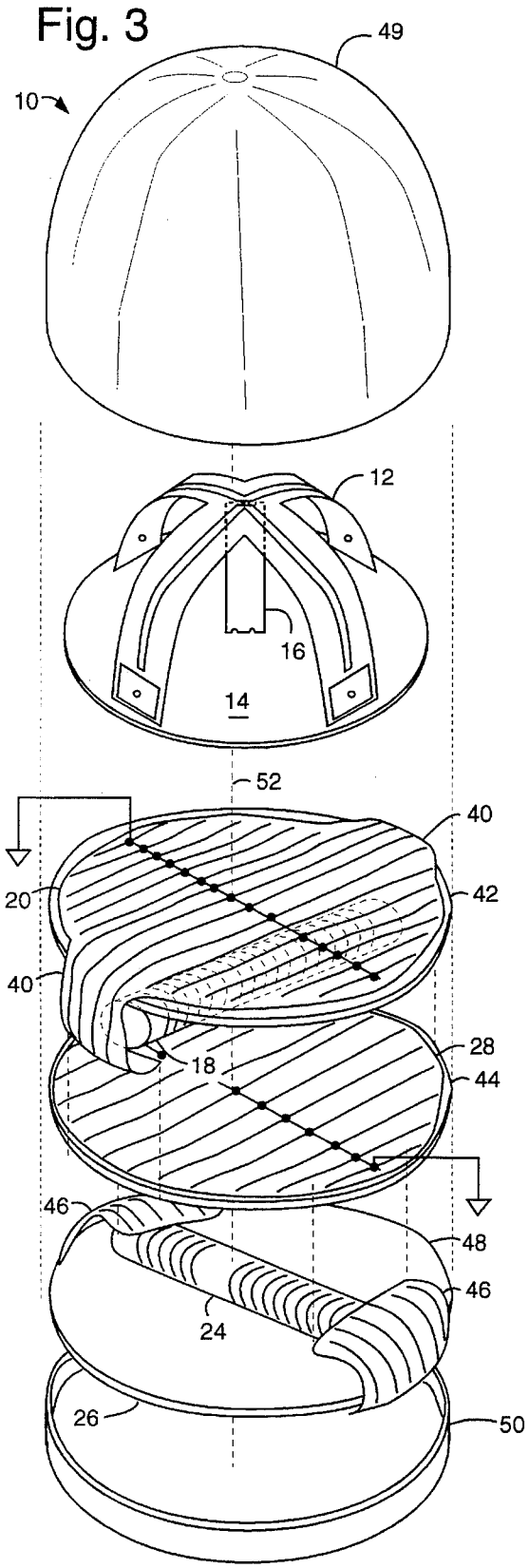
FIG. 3 is a perspective exploded view of the antenna combination of FIG. 1 with a folded dipole type of GPS antenna.
Figure 4:
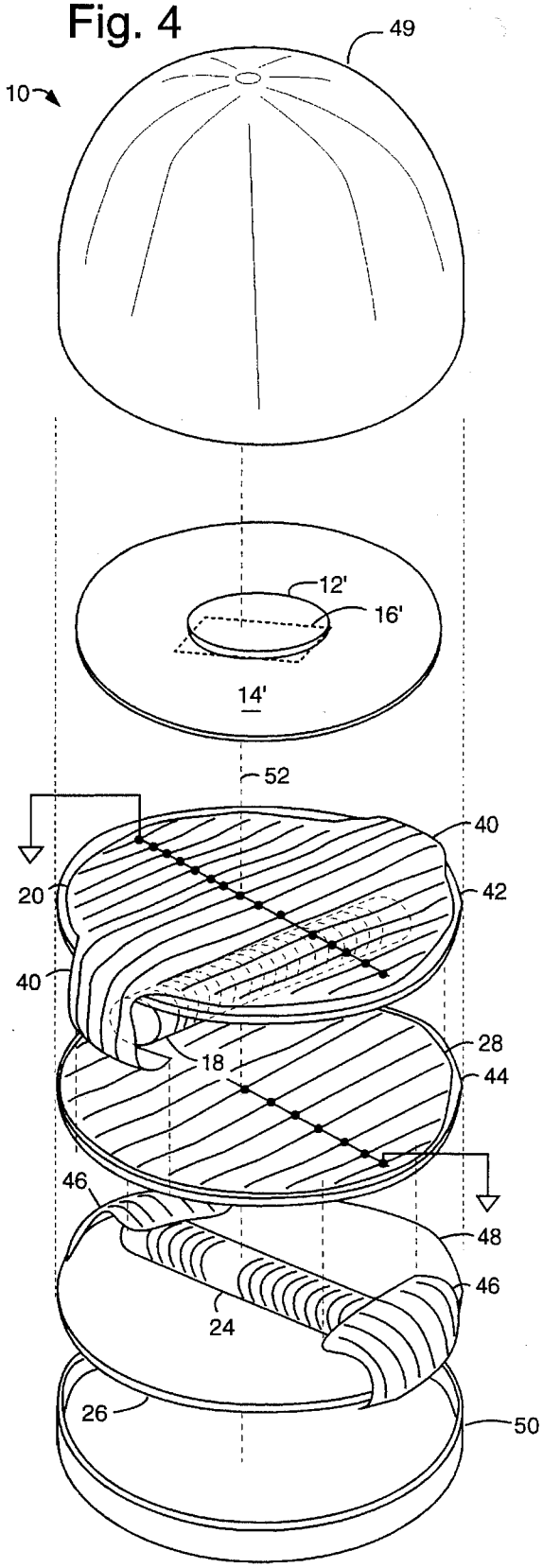
FIG. 4 is a perspective exploded view of the antenna combination of FIG. 1 with a patch-type GPS antenna.

In FIGS. 3 and 4, Faraday shields 20, 26 and 28 are circular sections of flat ribbon cable. A pair of tab ends 40 on Faraday shield 20 are folded down over a plate 42, passed respective ends of the magnetic loop antenna 18 and over and beneath another plate 44 with another Faraday shield 45. Since FIG. 3 is an exploded assembly diagram, the tab ends do not appear to be wrapping beneath the edges of the plate 44. A pair of tab ends 46 on Faraday shield 26 are folded up over a plate 48, passed respective ends of the magnetic loop antenna 24 and up and over the plate 44. Again, since FIG. 3 is an exploded assembly diagram, the tab ends 46 do not appear to be wrapping above the edges of the plate 44. FIG. 3 illustrates a ground connection through the center of the ribbon conductor comprising Faraday shield 20. A similar ground connection is made for the ribbon conductor comprising Faraday shields 26 and 28.

Antennas 18 and 24 are separated and orthogonal to one another to provide for omni-directional reception of differential correction beacon station signals. For example, such signals are broadcast at 300 KHz, and antennas 18 and 24 have a bandwidth of plus-or-minus twenty-five KHz. In one exemplary construction, the antennas 18 and 24 comprise ferrite rods wound with Litz wire, and are one-half inch in diameter and four and one-half inches long. Longer lengths of ferrite may be used to increase antenna sensitivity, but such lengths are preferable kept modest to allow for a reasonable overall size for antenna combination 10. Different diameters of ferrite rod may also be used, but one-half inch diameter material is readily available.

FIGS. 3 and 4 show a combination packaging of both GPS satellite antennas and beacon antennas. A radome 49 and a base 50 provide an enclosure to protect the antenna combination from the weather and mechanical injury, and is constructed of a plastic material that allows the unobstructed passage of GPS satellite signals.

In an alternative embodiment of the present invention, the plates 42, 44 and 48 are non-conductive circular, planar and concentrically stacked on a common axis 52, parallel to one another. To prevent substantial lowering of the antenna-Q of either antenna 18 or 24, any solid metal groundplane should be spaced away from antennas 18 and 24 by at least one and one-half inches.

In alternative embodiments that do not use a flat ribbon conductor to implement Faraday shields 20, 26 and 28, the Faraday shields 20, 26 and 28 are etched from metal clad on the plates 42, 44 and 48 to form combs that have each "tooth" connected at one end. to a common line that is circuit grounded. A common ground line connects through one end of each comb-tooth, or through their middles. Such construction allows for the shielding out of E-field noise signals and prevents the occurrence of eddy currents that would cause a loading of the radio field in the vicinity of antennas 18 and 24. The present invention is intended to include all such shapes and patterns of metal etching of shields 20, 26 and 28 that may accomplish these goals. Faraday shields 20, 26 and 28 may be constructed of copper clad on an epoxy fiberglass substrate and etched with conventional techniques.

FIG. 3 illustrates the antenna combination 10 as comprising an orthogonal folded dipole antenna 12 with an LNA 16 perpendicularly mounted and acting as a mechanical center post to hold the center of antenna 12 aloft from groundplane 14. The four dipole ends of antenna 12 are attached near the outside circular perimeter of the groundplane 14 and antenna 12 is thus imparted with a curve.

FIG. 4 illustrates an alternative embodiment of which the elements common to FIG. 3 carry the same reference numeral distinguished by a prime (′). In the embodiment of FIG. 4, the antenna combination 10 comprises the patch antenna 12′ and the LNA 16′ mounted beneath groundplane 14′. Given the variety of GPS antenna types known in the art, numerous combinations may be accommodated by the present invention.

Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An antenna system, comprising:

a microwave receiver antenna for receiving microwave radio transmissions from orbiting global positioning system (GPS) satellites and for connection to a GPS navigation receiver;

magnetic loop antenna means for connection to said GPS navigation receiver, and proximate to the microwave receiver antenna, and for receiving radio beacon transmissions that include differential correction information;

a radome providing for the enclosure and protection from weather and mechanical injury of the microwave receiver antenna and the magnetic loop antenna means disposed within, wherein the radome is comprised of material transparent to microwave radio signals and the relative placement of the microwave receiver antenna and the magnetic loop antenna means within the radome provides for a view of the sky by the microwave receiver antenna that is unobstructed by the magnetic loop antenna means; and radio electrostatic field shielding means comprising a plurality of similarly-oriented conductors that surround the magnetic loop antenna means where each of said conductors is open-ended and has a single connection to ground, wherein parasitic currents that would otherwise desensitize the magnetic loop antenna are prevented by open-ending said conductors.

2. An antenna system, comprising:

a microwave receiver antenna for receiving microwave radio transmissions from orbiting global positioning system (GPS) satellites and for connection to a GPS navigation receiver;

magnetic loop antenna means for connection to said GPS navigation receiver, and proximate to the microwave receiver antenna, and for receiving radio beacon transmissions that include differential correction information; and radio electrostatic field shielding means comprising a plurality of similarly-oriented conductors that surround the magnetic loop antenna means where each of said conductors is open-ended and has a single connection to ground, wherein parasitic currents that would otherwise desensitize the magnetic loop antenna are prevented by open-ending said conductors;

wherein, the microwave receiver antenna is oriented in an enclosure for upward vertical hemispherical radio signal reception; and wherein, the magnetic loop antenna means comprises a pair of ferrite rods mounted at right angles to one another and mounted beneath the microwave receiver antenna in said enclosure for horizontal omni-directional radio signal reception.

3. An antenna system, comprising:

a microwave receiver antenna for receiving microwave radio transmissions from orbiting global positioning system (GPS) satellites and for connection to a GPS navigation receiver;

magnetic loop antenna means for connection to said GPS navigation receiver, and proximate to the microwave receiver antenna, and for receiving radio beacon transmissions that include differential correction information; and radio electrostatic field shielding means comprising a plurality of similarly-oriented conductors that surround the magnetic loop antenna means where each of said conductors is open-ended and has a single connection to ground, wherein parasitic currents that would otherwise desensitize the magnetic loop antenna are prevented by open-ending said conductors;

wherein, the magnetic loop antenna means comprises two ferrite rods set at right angles to one another; and wherein, the radio electrostatic field shielding means comprises a plurality of conductors in a fan arrangement each positioned above, below and between said ferrite rods and spaced away from the magnetic loop antenna means to reduce antenna desensitization.

4. The antenna system of claim 3, wherein:

the radio electrostatic field shielding means comprises a flat ribbon conductor wrapped around the magnetic loop antenna means.

5. The antenna system of claim 3, wherein:

the radio electrostatic field shielding means comprises a flat ribbon conductor wrapped around the circumference of each of said ferrite rods with a spacing to reduce antenna desensitization and folded over an end of each of said ferrite rods.

6. An antenna system, comprising:

a microwave receiver antenna for receiving microwave radio transmissions from orbiting global positioning system (GPS) satellites and for connection to a GPS navigation receiver;

magnetic loop antenna means for connection to said GPS navigation receiver, and proximate to the microwave receiver antenna, and for receiving radio beacon transmissions that include differential correction information; and radio electrostatic field shielding means comprising a plurality of similarly-oriented conductors that surround the magnetic loop antenna means where each of said conductors is open-ended and has a single connection to ground, wherein parasitic currents that would otherwise desensitize the magnetic loop antenna are prevented by open-ending said conductors;

wherein, the magnetic loop antenna means comprises two ferrite rods set at right angles to one another with a set of three plates with one each plate positioned above, between and below said ferrite rods; and wherein, the radio electrostatic field shielding means comprises a flat ribbon conductor laid flat against each of said plates and spaced away from the magnetic loop antenna means to reduce antenna desensitization and having ends of said flat ribbon conductor folded over an end of each of said ferrite rods to embrace at least two of said plates.

* * * * *